United States Patent [19]

Reil et al.

[11] Patent Number: 4,593,730

[45] Date of Patent: Jun. 10, 1986

[54] LIQUID DISPENSING APPARATUS

[75] Inventors: Wilhelm Reil, Bensheim; Ulrich Deutschbein, Muhltal, both of Fed. Rep. of Germany

[73] Assignee: Tetra Pak Development, Pully, Switzerland

[21] Appl. No.: 630,650

[22] Filed: Jul. 13, 1984

[30] Foreign Application Priority Data

Jul. 16, 1983 [DE] Fed. Rep. of Germany ..... 3325747

[51] Int. Cl.[4] ..... B65B 3/12

[52] U.S. Cl. ..... 141/258; 141/89; 141/286

[58] Field of Search ..... 141/250–284, 141/285–310, 85–92

[56] References Cited

U.S. PATENT DOCUMENTS 4,437,498 3/1984 Pankratz et al. ..... 141/258

*Primary Examiner*—Houston S. Bell, Jr.

*Attorney, Agent, or Firm*—Paul & Paul

[57] ABSTRACT

Described is a filling apparatus for filling packaging means with quantitatively controllable amounts of a flow substance, having a pump piston (54) which is movable in a cylinder (50), wherein the feed end and the discharge end of the pump chamber (9) are respectively closed by valves (4, 5) and, to avoid foaming, the discharge end at least partially dips into the upwardly open packaging means (10). Also provided is a drive means (31, 37) with cam member (28). So that, as far as possible, only one essential machine component has to be moved, quantitatively controlled filling is possible, with a small height of drop, and preferably also the volume of filling can be varied without major conversion operation, it is provided in accordance with the invention that the annular pump piston (54) and the piston rod (6) are of a hollow configuration, the discharge end has a discharge nozzle (54') mounted on the end of the piston rod (6) that is remote from the piston (54), and the emptying valve (5), the feed valve (4) is arranged on the cylinder (50), and that the drive means (31, 37) has at least two rotationally mounted levers (31, 37) which are in adjustable driving engagement with each other, and a coupling means (21–23) which engages around the piston rod (6) and which is connected to one of the levers (37).

8 Claims, 8 Drawing Figures

LIQUID DISPENSING APPARATUS

Figure 1:
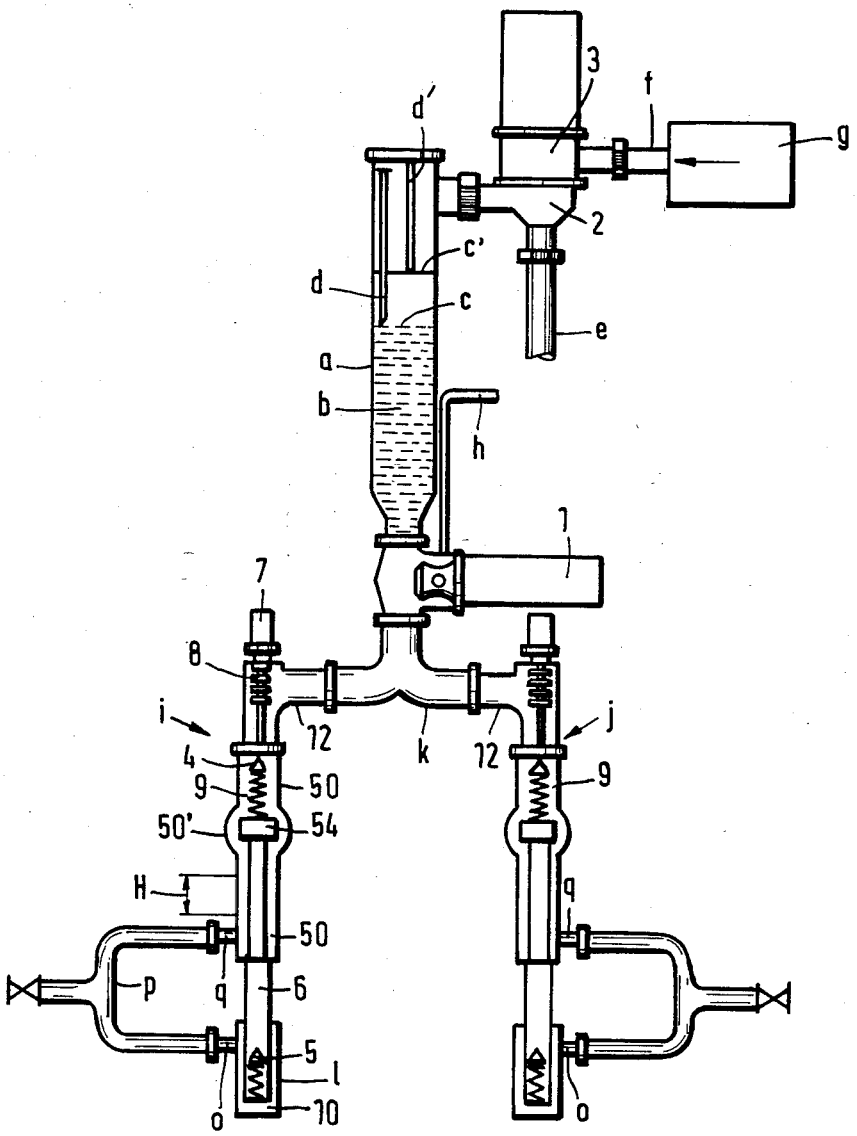

The invention relates to an apparatus for introducing a controllable amount of a flow substance into packaging means, having a pump chamher comprising a pump piston which is movable in a cylinder, an inlet end and an outlet end wherein inlet or the feed end and the outlet or discharge end of the pump chamber are respectively closed by valves and, to avoid foaming, the discharge end dips at least partially into the packaging means during filling, and having a drive means with a cam member.

Various apparatuses are known for filling packaging means with flow substances.

For example, German published specification (DE-AS) No. 27 34 251 discloses an apparatus having a tubular housing, with a resilient sleeve in the form of a hose member bearing against the interior of the tubular housing and being sealingly mounted to the periphery of the ends of the tube, wherein a support member is centrally secured in the tube, forming passages extending lengthwise in the tube, being of the same area as the inside surface area of the tube. That apparatus permits the metered filling of packaging means which are disposed in a row on a conveyor belt to be filled with metered amounts of fluids, for example juices or milk. That provides a freely movable metering means with a simple pump drive means so that in particular those fluids which tend to foam such as for example milk or juices can be introduced into packaging means.

It is known for the discharge nozzle of the filling means to be introduced a given distance into the packaging means to be filled, and to be retracted therefrom in an upward direction as the level of fluid in the packaging means rises. In the case of this pump, the opening of the discharge member is always kept below the surface of the fluid. Because of that, and by virtue of the support member with the resilient hose-like sleeve however, it is no longer possible to provide for very precise quantitative control of the fluids.

Another known filling apparatus is better, wherein disposed below the supply vessel is a pump cylinder and a dip or immersion tube which can be connected to the pump cylinder by way of a passage or duct. The packaging means to be filled are once again moved in a row by way of a conveyor, successively into position below the dip tube, and then lifted so that the packaging means surrounds the filling tube. When the discharge end of the dip tube is in the vicinity of the bottom of the packaging means, the filling operation is begun in that a piston discharges a quantity of fluid, which had been drawn into the cylinder in a precisely quantitatively controlled amount, downwardly through the dip tube, with the valve at the intake end being closed and the emptying valve which is diposed at the top of the dip tube being opened, the fluid being passed through a mesh disposed at the lower end of the dip tube and into the packaging means, as the packaging means moves downwardly. Although the foaming effect can be kept at a low level by virtue of the low height over which the fluid drops, that known apparatus has the disadvantage that there are two substantial components to be moved, namely the piston in the pump cylinder and the packaging means for lifting it and lowering it around the dip tube. Another undesirable consideration in that known apparatus is the fact that the discharge end of the dip tube dips into the fluid. More specifically, it has been found that, directly after the beginning of the operation of filling the packaging means, in spite of the dip tube, the lower discharge member thereof reaches the level of the fluid and the fluid then washes up over the discharge member.

The object of the present invention therefore, is to provide an improved filling apparatus of the kind set forth in the opening part of this specification, that as far as possible only one essential machine component has to be moved, quantitatively controlled filling is possible, with the minimum possible height of drop, and preferably also the volume can be varied, without substantial conversion.

In accordance with the invention, that object is achieved in that the annular pump piston and the piston rod are of a hollow configuration, the discharge or outlet end has a discharge member containing a discharge volume mounted on the end of the piston rod that is remote from the piston pump, a fed or inlet valve is arranged on a pump cylinder at the top thereof, and that the drive means has at least two rotationally mounted levers which are in adjustable driving engagement with each other, and a coupling means which engages around the piston rod and which is connected to one of the levers. In order to avoid moving and driving two components, pump piston with its piston rod is of a hollow configuration so that two functions are virtually achieved with one movement, namely that of the pump piston and the piston rod secured thereto, more specifically, such functions comprising both the operation of filling the apparatus with a controlled amount of flow substance and also the discharge of the flow substance to the respective packaging means in the desired manner, so that the discharge end of the discharge member at the beginning of the filling operation is close to the bottom of the packaging means. The piston rod is practically formed as a dip tube, so that the discharge member with the discharge valve is arranged at the discharge or bottom end thereof. Thereof, the feed valve is desirably arranged on the top or inlet end of the cylinder. By virtue of the adjustable driving engagement between two levers which are in operative engagement with each other, it is possible to change the desired metering volume without special assembly operations being required for that purpose.

Such an apparatus advantageously permits flow substances of widely varying consistencies to be handled, in particular fluids having a substantially wider range of viscosities than in the case of the conventional pumps as described above, but in particular also fruit juices with fruit pulp and the like.

The drive for the piston rod, which is by way of a coupling means engaging around the piston rod is also very simple, being coupled directly from the outside and without the need for special sealing means.

The sealing means which are required in the apparatus according to the invention are disposed at conventional locations which can thus be readily checked, so that not just milk and fruit juices but also fats and oils can be used therein. The degree of filling accuracy of the novel apparatus readily fulfills the requirements of the statutory provisions in regard to calibration and standards, and the filling volumes can be changed with the desired degree of accuracy.

In accordance with the invention, adjustment or alteration of the filling volume is achieved in that, in an advantageous embodiment, both levers are rotatable about parallel shafts and are formed with slots which mutually overlap in the zero position and parallel to which, in the zero position, at a central location, there is movably disposed a drivable screwthreaded spindle having an adjusting nut which, by way of trunnions and bearings, provides the driving engagement between the two levers. Alteration in the filling volume is flexible and infinitely adjustable by way of the screwthreaded spindle with the nut. It will be realized that adjustment of the delivery volume is also possible during operation. These are requirements which are frequently made by dairies when packaging milk or generally by the industrial inspection board. In continuous operation, when packaging foodstuffs, spot checks are made and the filling amount must be immediately adjusted if deviations therefrom are found. The adjustable driving engagement with the levers fulfils those requirements while at the same time providing a simple design in respect of the entire machine, in which the pump piston simultaneously represents the metering piston and the outlet valve.

The particularly desirable handling and simple design of the invention will be seen from the fact that, in another preferred embodiment according to the invention, the lever which can be brought into engagement with the cam member is connected to at least one pneumatic cylinder. The one pneumatic cylinder engages for example that location on the drive-side lever at which a roller follows a cam member, in order to withdraw the roller from the cam member and in that way generally to prevent pump operation when required, if for example no packaging means to be filled is to be found under the discharge member. The same or preferably a second pneumatic cylinder may be provided in order to withdraw the above-mentioned engagement end of the lever from the cam member by an even greater distance, into a cleaning position in which the second lever which is drivingly engaged with the first lever puts the piston rod and thus the overall arrangement into a cleaning position.

It is particularly advantageous if, in accordance with the invention, without any dismantling, the apparatus can be cleaned and also sterilized at the same time or thereafter (cleaning in place).

It is also desirable in accordance with the invention if the discharge member including the discharge value is removable and can be replaced by a cleaning cup having a discharge flange, while a further discharge flange can be provided on the lower end of the cylinder closest to the discharge arrangement. Those features also serve for cleaning and sterilizing the apparatus. It will be seen that the discharge member may be of a sleeve-like configuration and may screw on to the discharge end of the piston rod. By virtue of that arrangement, the discharge member is advantageously removable and can be replaced by the cleaning cup which only needs to have the same screwthread and thereby and by virtue of the discharge flange provided thereon, provides a cleaning circuit through which aseptic fluids can be pumped.

A first preferred embodiment of the invention is characterized in that the feed and discharge valves are spring-loaded towards the closed position and that the discharge end of the discharge member has a screen or strainer. While the arrangement of a screen or strainer on the discharge member is in fact known per se, as mentioned above, it gives, in conjunction with the foregoing features and by virtue of the spring-loaded valves, a particularly simple piece of equipment which can be advantageously used in particular for milk and juices without fruit pulp and, by virtue of having a small number of simple drive means, shows scarcely any susceptibility to breakdown and requires little maintenance.

Furthermore, when there are special wishes to be met or particular functions to be performed, it may be desirable for at least one of the valves to be movable by separate control devices. In the first-mentioned embodiment for fluids of low viscosity such as for example milk, venting of the apparatus can be effected at the beginning of operation thereof by a pneumatic cylinder providing for opening of the feed valve, so that the conduits can be vented when the filling material or product first flows in.

In another embodiment, which has already been mentioned above, with which fluids of higher viscosity or fruit juices with fruit pulp can also be introduced into packaging means, it is desirable for at least one of the valves to be controllable in order to cut any fruit pulp which is between the valve seat and the valve member. A pneumatic cylinder for example produces sufficient force to produce the cutting function, as will be described in greater detail hereinafter with reference to the specific description.

It is also advantageous in accordance with the invention if a transverse bar or rod is fixed to the discharge end of the discharge member, with both valves having cutting edges and being operable by a pneumatic cylinder. In this embodiment of the apparatus, neither the viscosity of the product to be introduced into the packaging means nor fruit pulp or the like therein can constitute any obstacle in regard to function of the apparatus in accordance with the invention, for the valves have cutting edges and are both operated in such a way as to ensure satisfactory closure of each valve. The transverse bar or rod member at the discharge end of the discharge member serves moreover in this second preferred embodiment as an abutment member for the possible stroke movement of a valve rod in order to simplify the drive for the valve which is most remote from a controlling pneumatic cylinder.

In another advantageous embodiment, the invention also provides that the feed valve is operable by way of an upper inlet valve member and the discharge valve is operable by way of a valve rod which can be coupled to the valve member. Those features also provide for simplicity of design and operation of the valves in the case of the second embodiment, when products with high viscosity values, fruit pulp or the like are to be used.

The above-described apparatus according to the invention, while being of a simple design and thus having a low level of susceptibility to troubles in operation, permits fluids to be introduced into finished packaging means, avoiding foaming, by the piston rod, in the suction stroke movement, being moved into a position in which the discharge member thereof is close to the bottom of the packaging means and ejecting the product to be introduced into the packaging means, in the subsequent pump stroke movement, wherein at the same time the discharge end of the discharge member is always kept above the surface of the fluid. In other words, in the filling operation, the discharge member moves slowly upwardly away from the bottom of the packaging means. In that respect, it is particularly desirable for the movement to be controlled in such a way that the distance between the lower edge of the discharge member and the level of the fluid gradually increases in the course of the filling operation. That increase in spacing in the course of the filling operation can be satisfactorily controlled by the corresponding cam member, and has the advantage that, in regard to packaging means whose open end is to be closed for example by a folded end portion, after the filling operation has been concluded, the level of the fluid remains below the region of the folded end portion, that is to say, the region of the packaging means which has the folding and stamped lines. In that embodiment also, the level of fluid at the beginning of the filling operation may be very close to the discharge end of the discharge member and only has to increase in the course of the filling operation in such a way that, at the end of the filling operation, the discharge member has come out of the packaging means, while the level of fluid is more or less closely below that region which contains the folding and stamped lines, in order thereby to ensure satisfactory closure of the packaging means which is then full.

Figure 2:
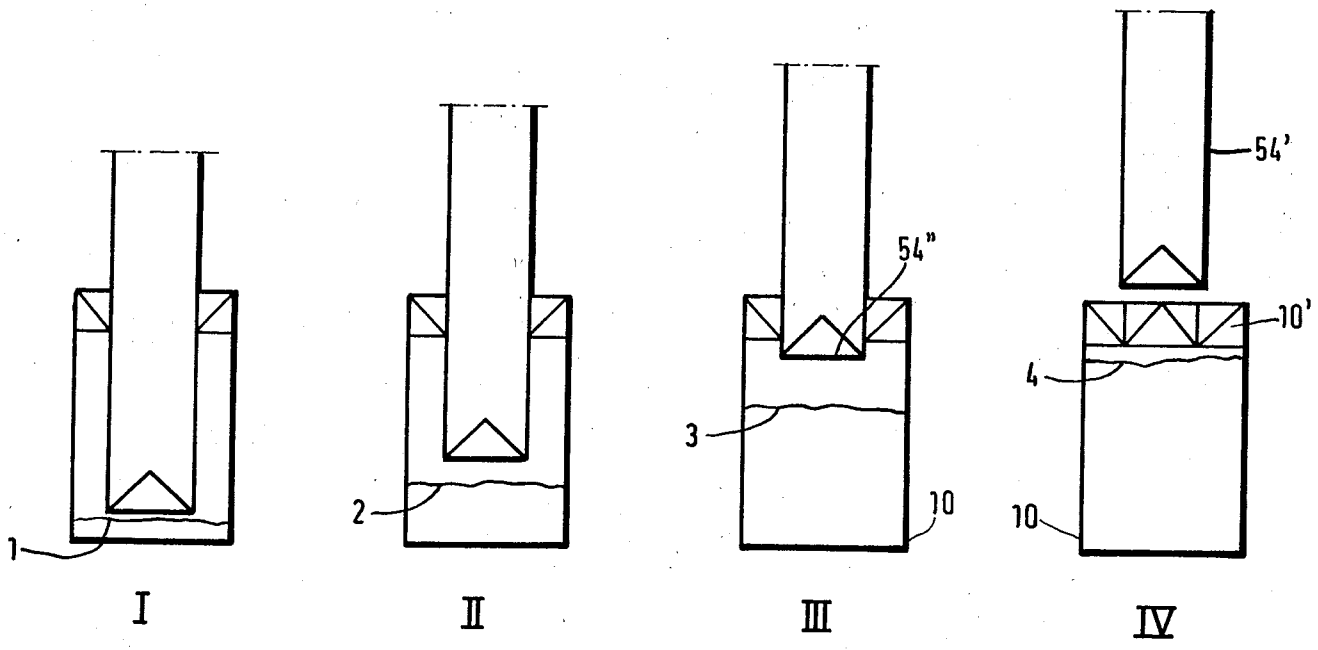
Figure 3:
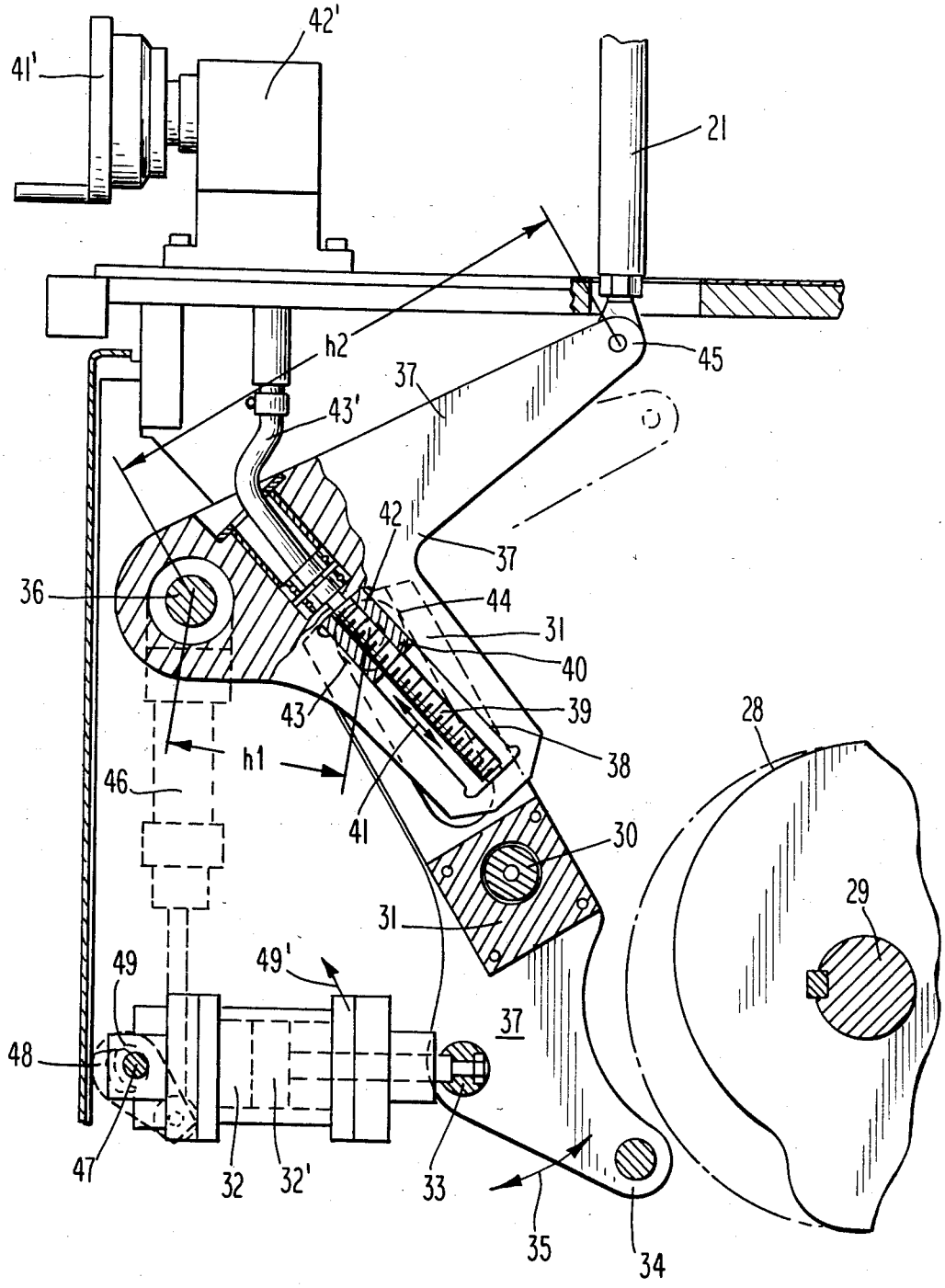
Figure 4:
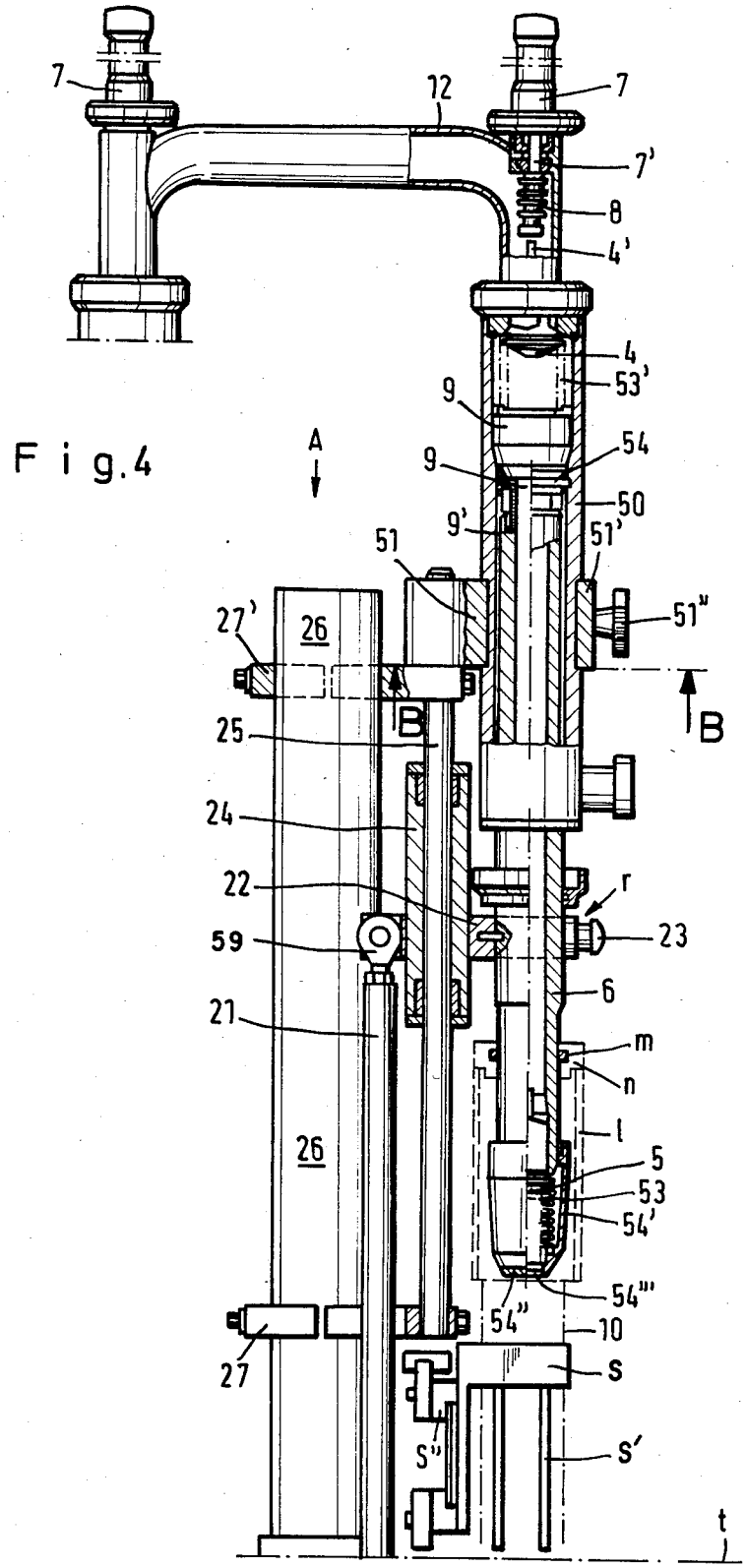
Figure 5:
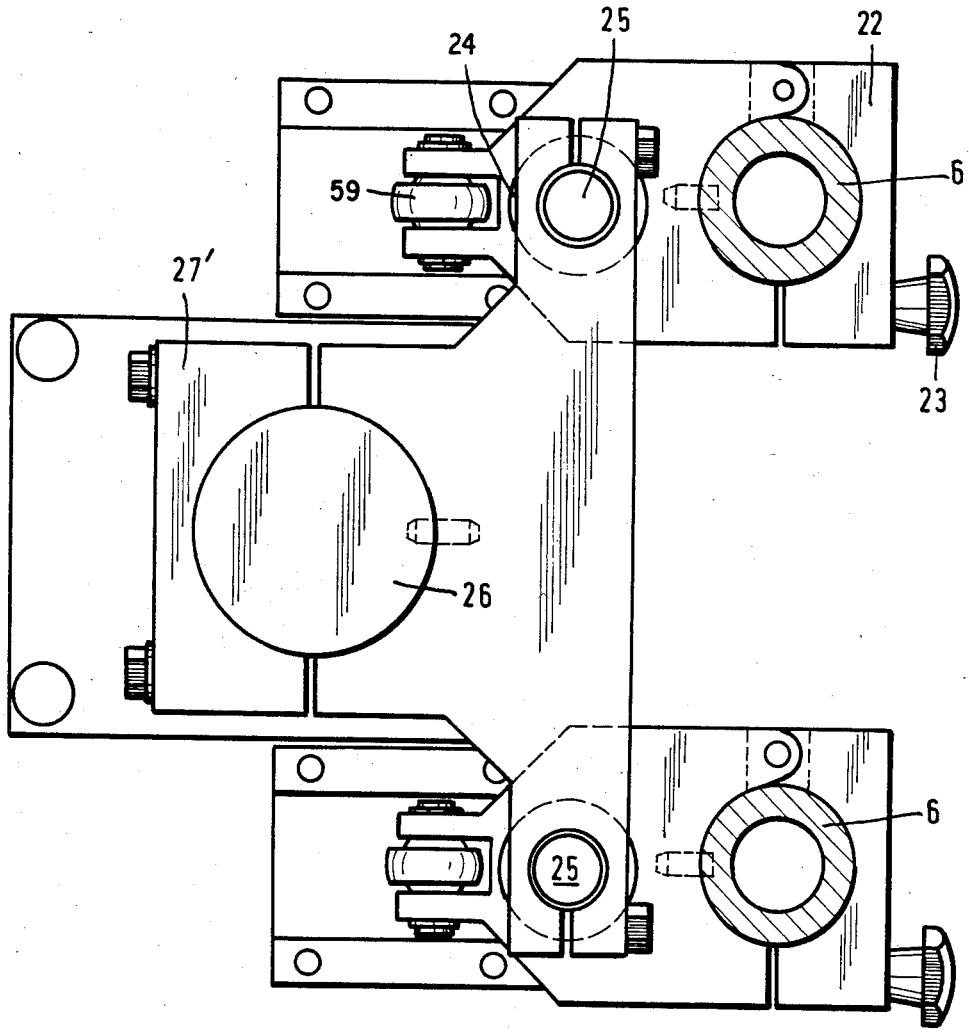
Figure 6:
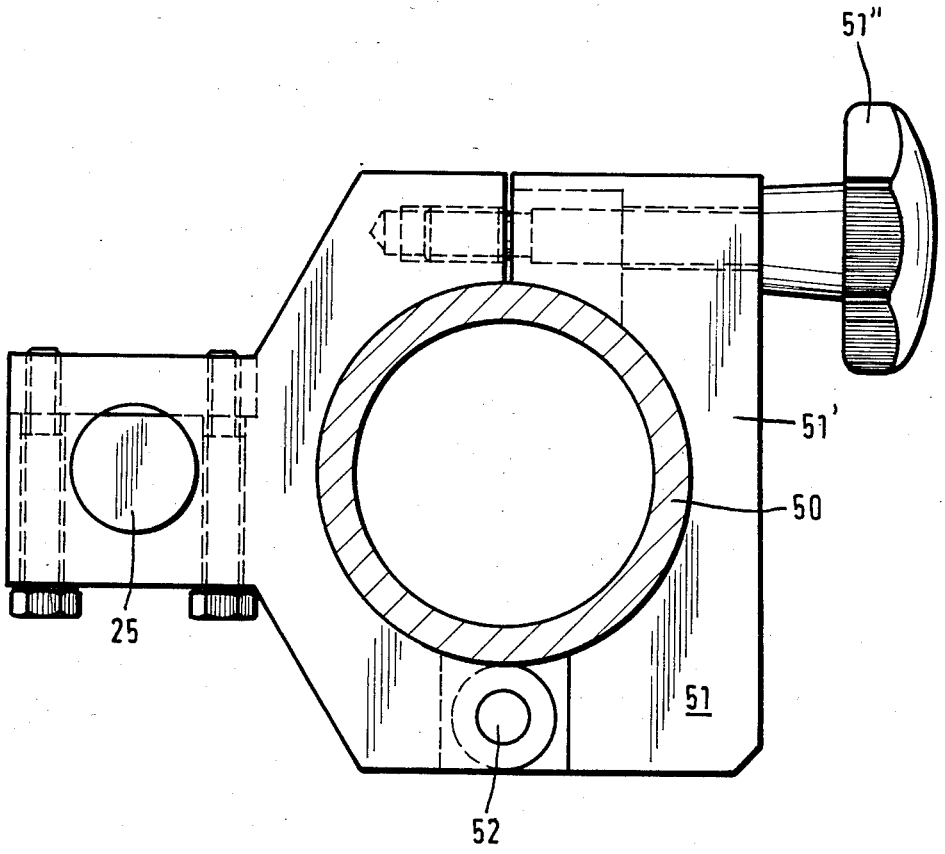
Figure 7:
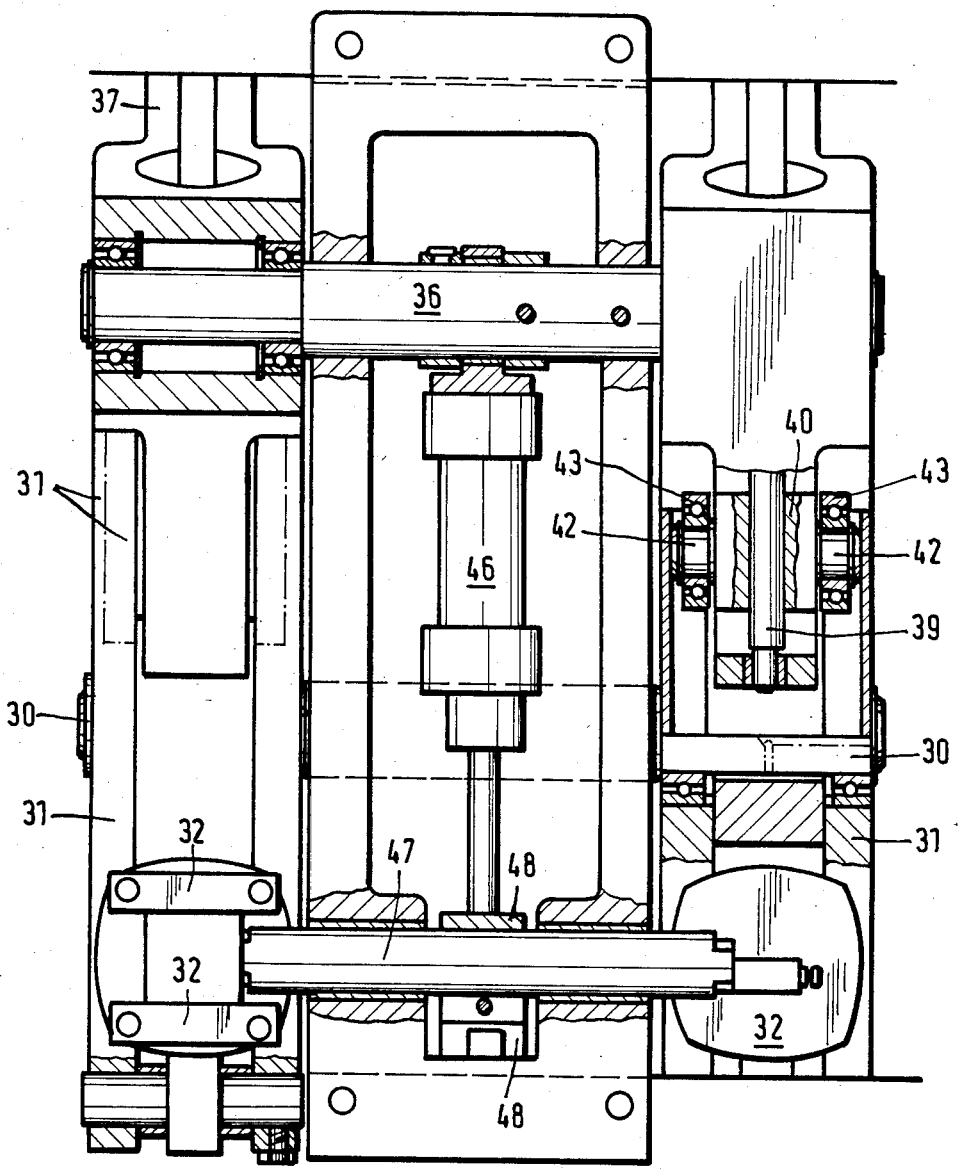
Figure 8:
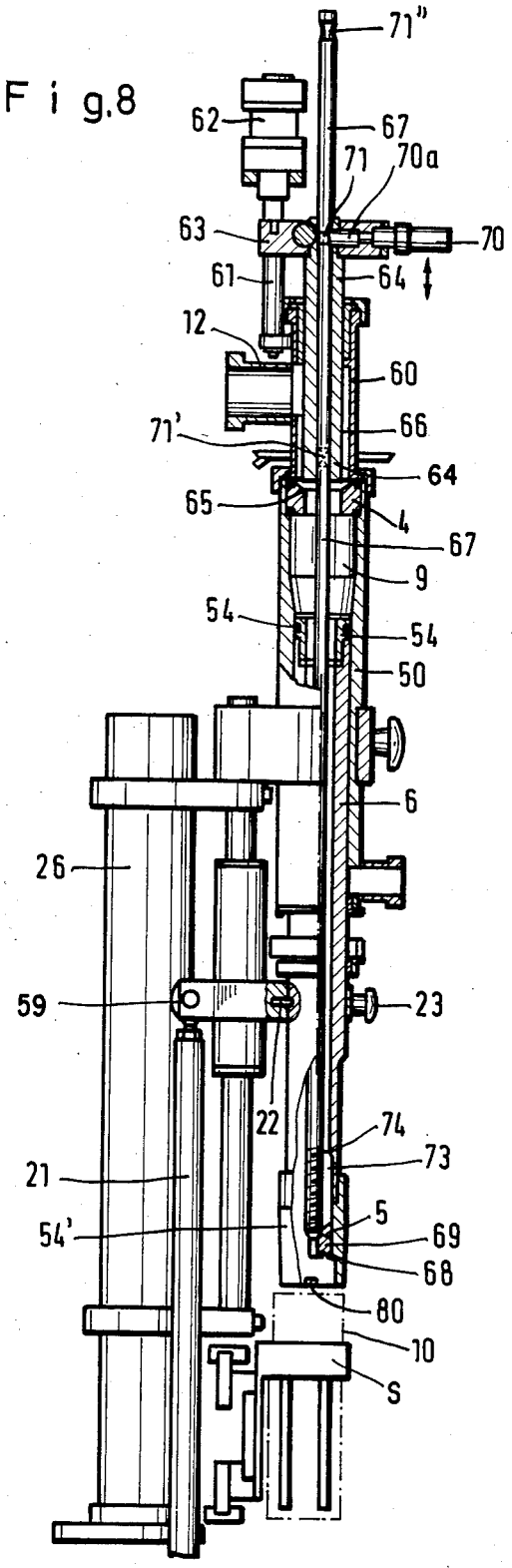

Further features, advantages and possible uses of the present invention will be apparent from the following description of preferred embodiments, with reference to the drawings in which:

FIG. 1 is a diagrammatic view of the overall design of the filling apparatus which is shown with a double piston and thus a double piston rod, whereas the other drawings, except for views showing portions, essentially show only one piston with one piston rod because that is adequate for the purposes of describing the invention, for both units of the double filler are of the same configuration, FIG. 2 diagrammatically shows four positions of the discharge member relative to the packaging means with the material filling same, FIG. 3 shows a simplified view of the construction of the drive means, FIG. 4 shows a simplified view of the piston rod, the pump cylinder and the feed end with the drive connections shown in broken-way form, FIG. 5 shows a view of the apparatus shown in FIG. 4, as viewed in the direction indicated by the arrow A, without the pump cylinder, FIG. 6 shows a detail view along line B—B of FIG. 4, FIG. 7 shows a partly sectional side view of the drive means of two piston rods, wherein the side view of the drive levers is shown in above-mentioned FIG. 3, and FIG. 8 shows a partly sectional side view of another embodiment with positively controlled valves, similar to the view shown in FIG. 4.

The overall construction of the double filling apparatus is shown in FIG. 1. Disposed above the product valve 1 is a feed vessel a with the fluid or product b diagrammatically shown therein, which fluid or product can be at a first level c and a second level c′ which is above the first level c. A probe d is provided to sense when the fluid exceeds the first level c, while there is also a second safety probe d′ that gives a special closure signal to the product feed means when the level of fluid in the vessel a reaches the maximum upper volume c′. The vessel a is connected by way of a valve 2 to a feed pipe e for cleaning fluid, on the one hand, and to a valve 3 which in normal operation permits the in take of air through the conduit f through the air filter g.

Before the apparatus is set in operation, cleaning and sterilization are required. For that purpose, the valve 2 is opened and the valve 3 is closed so that the sterilizing fluid can flow through the entire vessel a with the product valve 1 and all units which are disposed therebelow and which are still to be described. After the cleaning operation is concluded, the valve 2 is closed and remains closed in normal operation. In contrast, the valve 3 is opened, in order to permit air to enter through the air filter g during the fed flow of product into the vessel a. It is assumed that such control in respect of the level of fluid c and c′ in the vessel a can be effected in conventional manner. The feed flow of product comes from the diagrammatically indicated conduit h and by way of the valve 1 which is controlled by the probe d. That arrangement ensures that there is adequate fluid in the vessel a and permits a smooth feed flow into the actual filling apparatus, which is shown generally in the form of a double conduit i and j, wherein the distributor connecting member k is connected to the feed conduit 12 which can also be seen at the top in FIGS. 4 and 8.

Hereinafter, only the left-hand apparatus i will be described, with reference to FIG. 1, with the right-hand apparatus being described by way of example, with reference to FIGS. 4 and 8. First of all, a short description of the filling apparatus i shown in FIG. 1 will be set out, for the sake of clarity.

The feed valve 4 is disposed at the upper end of the pump cylinder 50 while the discharge valve 5 is provided at the discharge or lower end of the piston rod 6 with pump piston 54.

Moreover, the view shown in FIG. 1 illustrates the cleaning position in which the pneumatic cylinder 7 with the diaphgram 8 (see also FIG. 4) provides for opening the valve 4. The pump piston 54 is disposed in an enlarged portion 50′ of the cylinder 50, so that cleaning fluid which flows in from above in a downward direction can flow around the annular pump piston 54. Disposed at the downstream end of the piston rod 6 is a cleaning cup or pot 1 in the form of a hollow cylinder which is closed at one end and which is sealingly screwed in position by way of a seal m and an internal screwthread n (shown in broken lines at the bottom in FIG. 4), after the discharge member 54′ with valve 5 and biasing spring 53 (see FIG. 4) are removed. The cleaning cup or port 1 has a discharge or drain flange o for connection to a doubled emptying conduit p for cleaning fluids, the upper branch of which is connected to the arrangement by way of a second discharge or drain flange q.

The cleaning operation is carried out by cleaning fluid which flows from above, past the diaphragm 8, downwardly through the feed valve 4, then flowing into the hollow piston rod 6 in a downward direction into the cleaning cup or pot 1, issuing therein at the bottom thereof, and filling the space between the discharge end of the piston rod 6 and the inside wall surface of the cleaning cup or pot 1 in order to flow away by way of the flange o and the emptying conduit p. On the other hand, the cleaning fluid also flows around the outside of the pump piston 54, in order to go past the outside of the piston rod 6 to the flange q where it is also taken away by way of the emptying conduit p. It will be seen that the sterilization operation can be carried out without dismantling.

In the product filling mode of operation, the cleaning pot or cup 1 is to be considered as being removed so that the arrangement is in the condition shown in FIG. 4 in solid lines, with the packaging means identified by reference numeral 10 then being in position, as shown in FIG. 1, as will also be described in greater detail with reference to FIG. 4.

Finally, FIG. 1 also shows the stroke movement H of the pump piston 54, by way of example; the pump piston 54 is disposed at the upper end of the double-headed arrow H in the one position, and with the same edge at the lower level of the double-headed arrow H, in the production mode of operation. When the piston pump 54 moves downwardly from the upper position into the lower position, the space or chamber 9 is filled with fluid, being the product, which is supplied from above from the vessel a. For first filling the arrangement, the cylinder 7 provides for opening the valve feed 4 so that air can escape in the opposite direction to the direction of intake flow of the fluid.

The right-hand unit j is symmetrical in design with respect to the left-hand unit i, and therefore does not need to be described again herein.

FIGS. 2, 3 and 7 relate to the drive and the movement of the arrangement, so that reference will first be made to FIGS. 4 to 6 to describe the construction in greater detail, in this case for example in relation to the unit j of FIG. 1.

A stationary main carrier 26 which is shown in FIGS. 4 and 5 carries a guide rod or bar 25 which is also stationary, by way of a bridges 27 and 27'. The pump cylinder 50 of unit j is supported by way of the holder 51 (see FIGS. 4 and 6). For fixing purposes, the holder 51 has a bridge 51' with fixing screw 51'', which bridge can be pivoted about the journal or hinge 52. In that way, the pump cylinder 50 with the components mounted on it and attached to it, in particular also the conduit 12, can be mounted in a stationary condition.

The unit which is generally indicated as the coupling means r serves to transmit the drive movement from the drive means which is shown primarily in FIGS. 3 and 7, to the piston rod 6. The drive movement goes primarily by way of the rod 21 to the ball joint 59 to a connecting bridge 22, the design of which can be clearly seen from FIGS. 4 and 5. The bridge 22 is secured to the piston rod 6 by way of a screw 23 and FIG. 4 and FIG. 2, position IV show the neutral or zero position of the piston rod 6.

A mounting bushing 24 runs on the guide bar 25. The bushing 24 is secured to the connecting bridge 22 and provides for guiding the connecting bridge 22 and thus the piston rod 6 parallel to the stationary main carrier 26.

The packaging means 10 to be filled can be seen at the lower end in FIG. 4, the packaging means being carried in a special basket s, with rods or bars s' and a mounting means generally denoted by rods or bars s'', and is thus arranged above a machine table t. The discharge end 54'' of the member 54' is provided with a screen or filter 54''' while in the interior of member 54' the compression spring 53 is supported in such a way that the valve 5 is biased in the closed position shown in FIG. 4. The cleaning pot or cup which is shown in broken lines is removed, in that condition.

It will be seen that the discharge valve 5 with the spring 53 and the discharge member 54' are mounted at the discharge or lower end of the piston rod 6. Disposed at the opposite upper end of piston rod 6 is the annular pump piston 54 in the form of a rubber sleeve, the hollow design of the piston rod 6 also being visible. Disposed in and above the piston pump 54 is the above-described space or chamber 9 while the space or chamber 9' is formed around the piston rod 6. The cylinder 50 engages around the piston rod 6, approximately in the upper half. The spring 53' of the feed valve 4 is also supported in the cylinder 50, at the top, and urges the valve into the closed position, as shown.

Also shown is the pin 4' of the feed valve 4, against which the pushrod 7' of the cylinder 7 can press from above, extending out of the chamber or space within the teflon diaphgram 8, in order, during this special control mode, to open the feed valve 4 for example for the venting operation at the beginning of operation of the apparatus.

The drive means will now be described with reference to FIGS. 3 and 7. Carried on a main shaft 29 and fixed in position by way of a slot and key connection is the cam disc 28 which, in the view shown in FIG. 3, is shown lifted away from the cam roller 34 of the first lever 31, for in the position illustrated in solid lines, the first lever 31 is in the cleaning position. The main shaft 29 is driven by a main door (not shown). The first lever 31 is mounted on the pivotal shaft 30 and has a slot or fork 44.

Shown in FIG. 3 at bottom left in the first lever 31 is a pivot mounting means 33 to which a first pneumatic cylinder 32 is secured, in order to move for example the first lever 31 along the path indicated by the double-headed arrow 35, and to draw it towards the left for the position shown in FIG. 3, which is the cleaning position.

It will be appreciated that positioning in the cleaning position is additionally effected by the second pneumatic cylinder 46, as will be described below.

For the drive operation, the first lever 31 co-operates with the second lever 37 which is shown in broken lines in the neutral or zero position. The upper end of lever 37 is shown in solid lines in the cleaning position. It can be seen that a ball bearing means 43 forms an operative connection between the levers 31 and 37 so that when the lever 31 is rotated about the shaft 30, the second lever 37 is pivoted about the shaft 36 thereof. The magnitude of the stroke movement results from the lever ratio h1:h2.

When in the neutral position, the slot 44 of the first lever 31 and a slot 38 in the second lever 37 are mutually parallel. A nut 40 is displaced in the slot 38 by way of a screwthreaded spindle 39, by rotation of a drive wheel 41' by way of an angle transmission 42' and a flexible shaft 43' (also flexible hose), more specifically when the spindle 39 is turned. By virtue of that arrangement, the nut 40 can be moved in the slot 38 in the direction shown by the double-headed arrow 41.

FIG. 7 shows a side view, wherein the journals 42 are shown as projecting laterally out of the nut 40. Each of the journals 42 carries a respective ball bearing assembly 43 which runs in the slot 44 in the first lever 31 and thus provides for the driving engagement. Therefore, the movement of the ball bearing assembly 43 in the fork 44 in the first lever 31 produces the lever change h1:h2. By virtue of that arrangement, different amplitudes or stroke movements in respect of the piston rod 6 occur at the connection 45 of the second lever 37 to the connecting rod 21.

Adjustments in the neutral position is such that, upon movement of the nut 40 in the direction of the arrow 41, there is no movement of the connecting rod 21 or the second lever 37. For that reason, the longitudinal extent of the fork 44 is precisely centrally aligned to the pivotal shaft 30. By virtue of that arrangement, when the nut 40 moves along the line of the arrow 41, there is no change in the neutral or zero position, that is to say, the piston rod 6 remains in its highest position when adjustment is effected.

It will be appreciated that, in operation, after conversion adjustment, there is a maximum rotation of the second lever 37 about the shaft 36 when the nut 40 is in the uppermost position illustrated, in the slot 38 in the second lever 7. If, in contrast, as shown in FIG. 3, the nut 40 is moved downwardly and towards the right in the direction indicated by the arrow 41, and is in the bottom of the slot 38, than a pivotal movement of the first lever 31 about the shaft 30 produces only a short stroke movement in respect of the second lever 37.

It is also desirable for both slots 38 and 44 to be precisely centrally aligned with respect to the shaft 30, that is to say, the axis thereof must also be normal to the spindle 39 if conversion adjustment is to be provided, while avoiding a stroke movement.

When a sensor (not shown in drawings) detects that there is no packaging means 10 present in operation under the discharge member 54' and consequently product may not be discharged, then it is possible, by actuation of the pneumatic cylinder 32, to provide that there is no possibility of a pump movement. More particularly, in that case the supply of air is switched over from the side, which is on the left in FIG. 3, of the piston 32' of the cylinder 32, to the right-hand side of the piston. That causes the lever 31 and therewith the cam roller 34 to be moved into the neutral or zero position. The roller 34 lifts somewhat away from the cam 28. The levers 31 and 37 and consequently also the drive connecting rod 21 then remain stationary.

If the filling apparatus is to be moved into the position for cleaning, the piston rod 6 must be moved into a completely different stroke position, as shown in FIG. 1. That is achieved by the cam member 28 first being stopped in the cleaning position, as far as possible in the position shown in FIG. 3, so that there is the cleaning spacing, as illustrated, between the cam roller 34 and the cam surface 28.

The above-mentioned second pneumatic cylinder 46 is carried by way of a lever 48 on an eccentric shaft 47. Fixed in turn on the lever 48 are the two pneumatic cylinders 32, one cylinder for each unit i and j respectively. Pivotal movement of the eccentric shaft 47 as shown in FIG. 3 rearwardly and towards the left in the direction indicated by the arrow 49 causes the cylinders 32 to be correspondingly retracted towards the left in the direction indicated by the arrow 49'. By virtue of that movement, the cam roller 34 is moved even further towards the left in the direction of the left-hand part of the double-headed arrow 35. By way of the ball bearing assembly 43 and nut 40, the second lever 37 is pulled upwardly into the cleaning position shown in solid lines.

The drive, the means for adjusting the filling volume and the cleaning position have now been described.

In normal operation, the apparatus operates in such a way that, in the suction mode, the pump piston 54 with piston rod 6 is moved downwardly, whereby fluid is sucked in, with an increase in the size of the chamber 9. In that phase, the spring-loaded feed valve 4 is open while the discharge valve 5 is closed. After the chamber 9 is completely filled, the stroke movement is reversed, the feed valve 4 is closed, the discharge valve 5 is opened and the filling operation begins.

FIG. 2 shows four different operating positions. The filling operation has just begun in the first position I. The lower discharge end 54'' of the discharge member 54' is disposed at a small distance above the surface of fluid (1). After a certain rotary movement of the cam member 28, the position is position II in which the discharge end 54'' of the discharge member 54' is already spaced by a somewhat greater distance from the level of fluid (2) which is now higher. In following position III, that spacing from the level of fluid (3) in the packaging means 10 has increased further while finally, in the final position IV, the spacing between the end 54'' and the level of fluid (4) is at its greatest, so that more specifically the region 10' at the top of the packaging means 10, which carries the folding and stamped lines, is both free of fluid and also of the discharge member. Adjustment of the appropriate movement in order to provide the increasing spacing referred to above depends on the relationship of the base surface diameter of the packaging means and of the piston, and of the piston rod at the top and the height of the packaging means. Therefore, the height and the base area of the packaging means are the necessary condition for establishing the piston rod diameter. Preferably, a different piston rod should be used for each type of packaging means.

If fluids of higher viscosity values or with fruit pulp or the like are to be introduced into packaging means, the other embodiment shown in FIG. 8 is preferably used. The same components in FIGS. 4 and 8 are denoted by the same reference numerals, or are not separately identified. The differences between the particular embodiments are described hereinafter. Additive materials in fluids, which additive materials can be cut, can be processed with the filling apparatus shown in FIG. 8 because the valves 4 and 5 are no longer spring-loaded as in the case of the first embodiment shown in FIG. 4, but are operated pneumatically. Connected to the pump cylinder 50 by flange means is the valve housing 60 on which there is disposed a carrier 61 for a pneumatic cylinder 62. The cylinder 62, by way of the connection 63, moves the valve member 64 which can also be referred to as the upper inlet valve member. A double-headed arrow in the valve member 64 shows the possible movement thereof. The neutral or zero position is shown in FIG. 8, in which the feed valve 4 is open.

A cutting edge 65 and 68 can be seen both on the feed valve 4 and on the discharge valve 5 respectively. Moving the lower end of the upper inlet valve member 64 past the cutting edge 65 of the feed valve 4 and likewise moving the valve edge 69 of the discharge valve 5 past the cutting edge 68 produce shearing forces which cut up the additive materials in the fluids.

FIG. 8 shows the suction intake or zero position of the apparatus. The material to be introduced into the packaging means has passed into the suction chamber 9 because the feed valve 4 is open and the valve member 64 is at a spacing from the cutting edge 65.

A valve rod 67, which, in its upper region, has two openings 71, 7', 71'' respectively at the spacing of the stroke movement from each other forms the connection from the pneumatic cylinder 62 to the discharge valve 5.

That connection is made by way of a coupling means which has a coupling cylinder 70 with piston rod **70*a*. They are disposed in the region of the connection 63, while all stationary members, for example the valve housing 60 and the mounting means of the cylinder 62, are mounted by way of the carrier 61**.

The lower part of FIG. 8 shows the sharp-edged configuration of the discharge valve 5, with the valve edge 69 which co-operates with the cutting edge 68 on the discharge member 54'. The lower end thereof is not provided with a screen or filter but with a transverse bar or rod member 80 because even fruit pulp which has been cut up could not pass through the screen or filter. When the valve rod 67 moves, the discharge valve 5 can be moved downwardly until it bears against the transverse member 80; and moved upwardly until a star member 73 fixedly carried on the rod 67 bears against the abutment 74.

The apparatus of the above-described construction operates in such a way that, upon synchronous movement of the valves 4 and 5 relative to each other, the pneumatic cylinders 62 and 70 are actuated in a given fashion.

For the purposes of filling the packaging means 10, the piston rod 6 and, by way of the connection 73, 74 the valve rod 67 moves downwardly from the position shown in FIG. 8 until the lower end of the discharge member 54' has reached a position close above the bottom of the packaging means to be filled. During that operation, the chamber 9 has filled because the feed valve 4 has been left open and the discharge valve 5 has been left closed.

Both openings 71, 7', 71" (there are only two openings in the valve rod 67, which are disposed at the spacing of the stroke movement from each other) are provided to ensure that there is a clearly adjusted position in respect of the valve rod 67.

In the above-described operating position, more specifically when the lower edge of the discharge member 54' is in the region ofthe lower end of the empty packaging means, the opening 71 has reached the position 71' shown in broken lines.

The operation of filling the packaging means now begins. The piston 70*a* of the cylinder 70 moves towards the left into the opening 71 so that the valve rod 67 is latched in position. With regard to the description of FIG. 8 it must be noted here that that movement involves the piston rod 70*a* moving into that opening which, in the view and position shown in FIG. 8, is denoted by 71" at the top.

The pneumatic cylinder 62 is then actuated, which moves the upper inlet valve member 64 downwardly, more specifically together with the valve rod 67 whereby the feed valve 4 is closed and the discharge valve 5 is opened. The upward stroke movement of the piston rod 6 and ejection of the fluid mixed with fruit pulp now begins. The transverse member 80 serves as a means for limiting the movement of the valve rod 67 (in its movement in a downward direction). When therefore the lower end of the valve rod 67 rests against the transverse member 80, the discharge valve 5 is opened to its maximum and, in that condition, the piston rod 6 moves by its stroke movement fully upwardly into the position shown in FIG. 8. As the valve rod 67 also moves upwardly together with the piston rod 6, the opening 71 is moved from the dotted-line position 71' upwardly again into the middle position 71. After the arrangement has reached the neutral position shown in FIG. 8, the coupling cylinder 70 closes again and the pneumatic cylinder 62 is retracted into its upper position as illustrated.

It should be emphasised as being particularly advantageous that the piston rod 6 is only slidingly guided in the cylinder 50 by way of the annular pump piston 54, at the top, as shown in Figure 4. In the lower region, the piston rod 6, in the cylinder 50, has no guide means. Here, that is taken out by way of the connecting bridge 22 and the mounting bushing 24, to the stationary guide rod 25.

We claim:

1. An apparatus for introducing a controllable amount of a liquid substance into a packaging means, comprising:

(a) a hollow annular pump piston movably disposed within a cylinder;

(b) a hollow piston rod attached to said pump piston being only partially disposed at its upper end in said cylinder;

(c) a feed end disposed at the top of said cylinder having a feed valve;

(d) a discharge end disposed at the bottom of said piston rod, remote from said pump piston and said feed end, having a discharge member and a discharge valve and characterized in that said discharge end dips at least partially into an open packaging means;

(e) drive means for moving said piston rod and said pump piston within said cylinder having at least two rotationally mounted levers which are in adjustable driving engagement with each other, and characterized in that at least one of said levers is capable of engagement with a cam member, and coupling means for connecting said piston rod to at least one of said levers.

2. The apparatus of claim 1 wherein said levers are rotatable about parallel shafts and are formed with slots that are in parallel arrangement and mutually overlap in the neutral position, and further comprising a driveable screwthread spindle disposed within said slots, and an adjusting nut threaded on said spindle having trunnions and bearing to provide the driving engagement between the two levers.

3. The apparatus of claim 2 wherein the lever that can be brought into engagement with the cam member is connected to at least one pneumatic cylinder which, when activated, will pull the lever away from said cam member.

4. The apparatus of claim 3 wherein the discharge member containing the discharge valve is removable, and including a cleaning cup having a discharge flange which can be mounted on the discharge end of said piston rod when the discharge member is removed, and further comprising a second discharge flange which can be mounted on the discharge end of said cylinder.

5. The apparatus of claim 4 wherein the feed and discharge valves are spring-loaded in the closed position and the discharge member has a screen or filter diposed at the lower end thereof.

6. The apparatus of claim 5 wherein at least one of the valves is movable by separate control means.

7. The apparatus of claim 4 wherein the feed and discharge valves are actuable by at least one pneumatic cylinder and have cutting edges, and further comprising a transverse bar disposed at the lower end of the discharge member and carried thereby.

8. The apparatus of claim 7 wherein the feed valve is operable by way of an upper inlet valve member and the discharge valve is operable by way of a valve rod which can be coupled to the valve member.

* * * * *

UNITED STATES PATENT OFFICE

CERTIFICATE OF CORRECTION

Patent No. 4,593,730 Dated June 10, 1986

Inventor(s) Wilhelm Reil and Ulrich Deutschbein

It is certified that error appears in the above-identified patent and that said Letters Patent are hereby corrected as shown below:

35 U.S.C. 254

Column 1, Line 6, "chamher" should be "chamber";
Column 1, Line 8, after "wherein" insert "the" and delete "the" before the word "feed";
Column 2, Line 18, "volume" should be "valve";
Column 2, Line 19, "fed" should be "feed";
Column 2, Line 26, after "components," insert "the";
Column 2, Line 39, "Thereof" should be "Therefore";
Column 7, Line 11, "valve feed" should be "feed valve";
Column 8, Line 17, "door" should be "motor";
Column 9, Line 7, "7" should be "37";
Column 10, Line 55, " 71,7',7" " should be " 71,71" ";
Column 11, Line 23, " 71,7',71" " should be " 71,71" ";
Column 11, Line 30, "ofthe" should be "of the";

35 U.S.C. 255

Column 3, Line 16, "fulfils" should be "fulfills";
Column 11, Line 62, "emphasised" should be "emphasized".

Signed and Sealed this

Sixteenth Day of September 1986

[SEAL]

Attest:

DONALD J. QUIGG

Attesting Officer

Commissioner of Patents and Trademarks